US006158996A

United States Patent [19]

Becher

[11] Patent Number: 6,158,996

[45] Date of Patent: Dec. 12, 2000

[54] SCREW ROTOR SET

[75] Inventor: Ulrich Becher, Porrentruy, Switzerland

[73] Assignee: Ateliers Busch S.A., Chevenez, Switzerland

[21] Appl. No.: 09/242,228

[22] PCT Filed: Jul. 21, 1997

[86] PCT No.: PCT/CH97/00279

§ 371 Date: Feb. 11, 1999

§ 102(e) Date: Feb. 11, 1999

[87] PCT Pub. No.: WO98/11351

PCT Pub. Date: Mar. 19, 1998

[30] Foreign Application Priority Data

Sep. 12, 1996 [CH] Switzerland ..... 22331/96
Oct. 4, 1996 [CH] Switzerland ..... 2417/96

[51] Int. Cl.[7] ..... F01C 1/16

[52] U.S. Cl. ..... 418/201.1; 418/151; 418/94

[58] Field of Search ..... 418/201.1, 151, 418/94

[56] References Cited

U.S. PATENT DOCUMENTS 2,266,820 12/1941 Smith ..... 418/201.1
2,441,771 5/1948 Lysholm ..... 418/201.1

FOREIGN PATENT DOCUMENTS 487588 10/1952 Canada ..... 418/201.1
62-291486 12/1987 Japan ..... 418/201.1
402305393 12/1990 Japan ..... 418/201.1
201026 3/1959 Sweden ..... 418/201.1
670395 4/1952 United Kingdom ..... 418/201.1
95-02767 1/1995 WIPO ..... 418/201.1

*Primary Examiner*—Thomas Denion
*Assistant Examiner*—Theresa Trieu
*Attorney, Agent, or Firm*—Clifford W. Browning; Woodard, Emhardt, Naughton, Moriarty & McNett

[57] ABSTRACT

Known designs of single-thread screw rotors in single-piece cast iron constructions having wrap angles of >720 degrees with balancing cavities on the face of the screw operate with no unbalance at average rotary frequencies of (~3000 $min^{-1}$). The use of a pump in processes having sensitive purity and maintenance requirements or working with corrosive substances or where limited space is available and quality is demanded, brings about problems for rotor designing and balancing, which the present invention solves. An uneven mass distribution is accomplished by constructing the rotors with several single parts inside the rotor, by forming cavities and/or by choosing the adequate material, which, combined with the screw length/pitch ratio, cause a static and dynamic balancing. Screw rotors designed as described offer several advantages since they are easy to assemble and have a compact and stable construction. Moreover, they can be used in pumps for the food industry, chemistry, medicine and semi-conductor construction due to the flexibility in material and to the smooth surfaces free from cavities.

20 Claims, 9 Drawing Sheets

Figure 1:
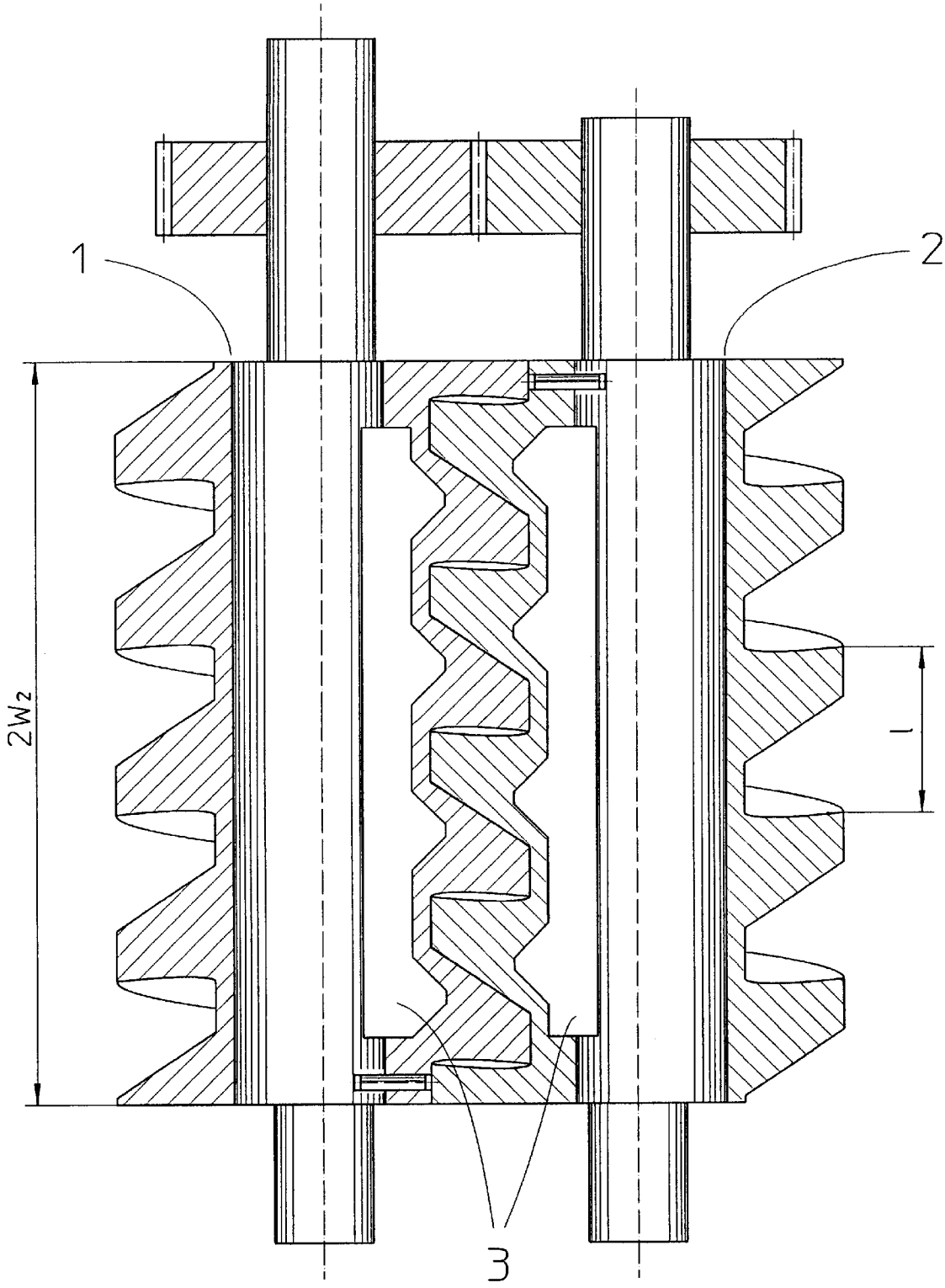

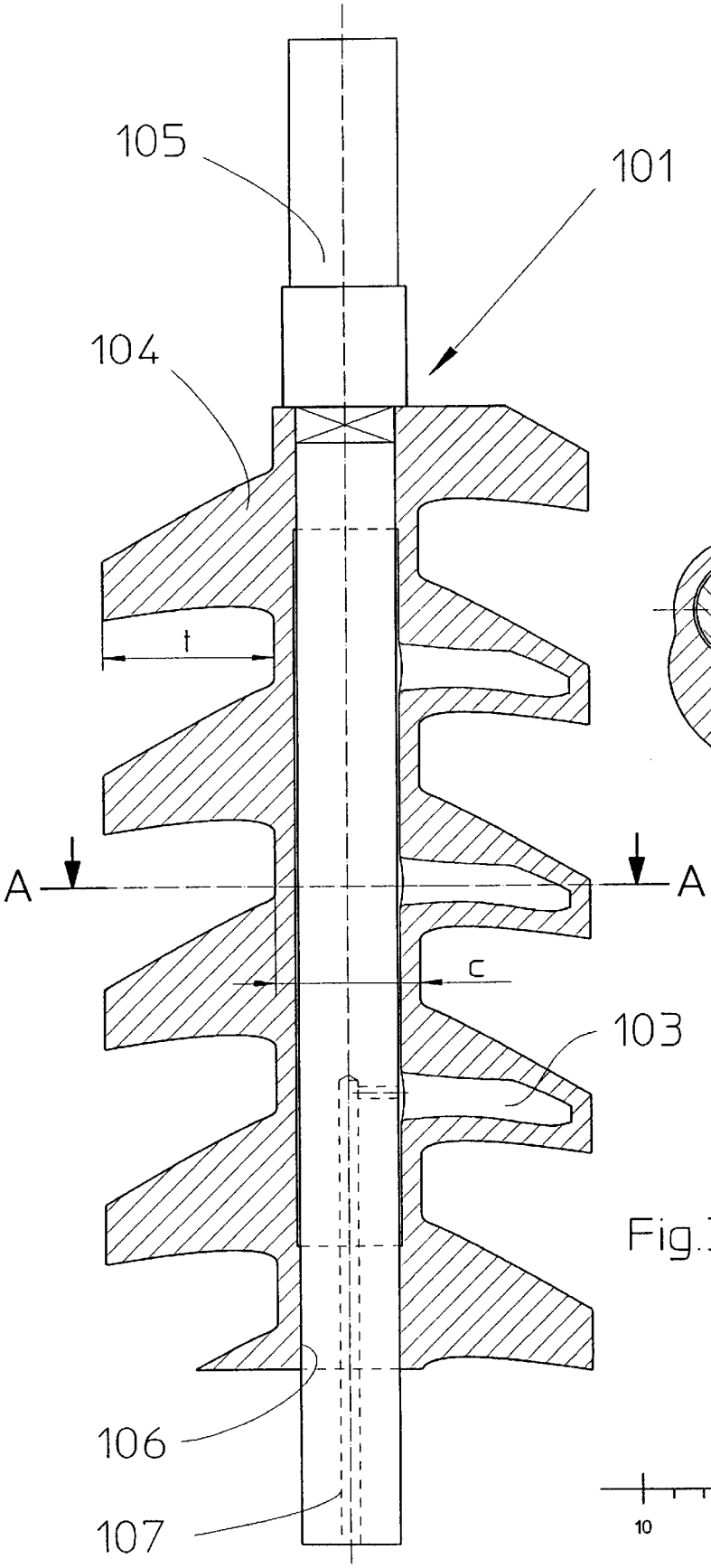
Fig.3
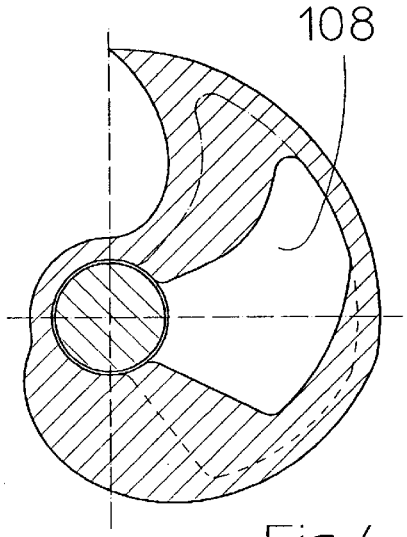
Fig.4
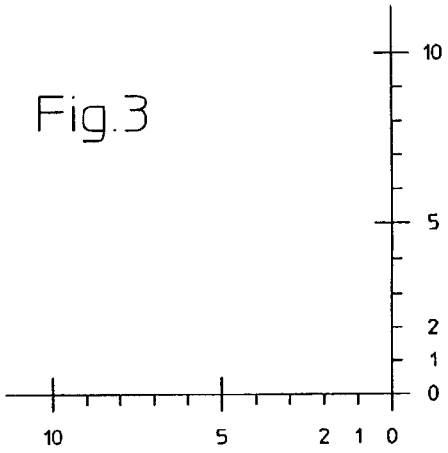

1 L.E.=1 cm

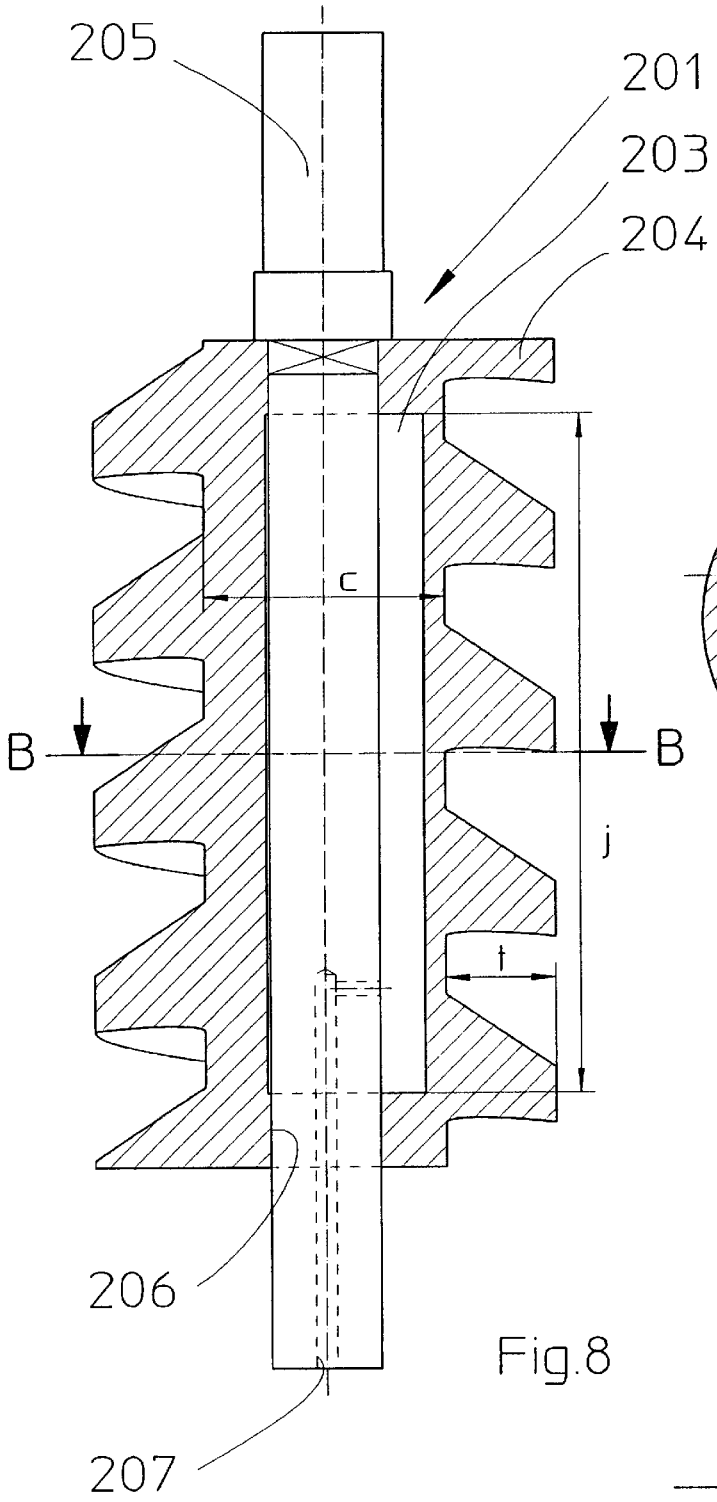
Fig.8
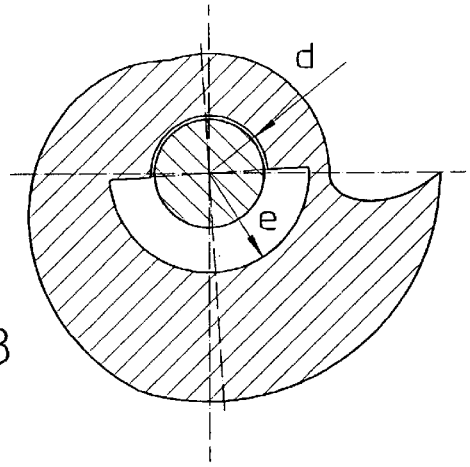
Fig.9
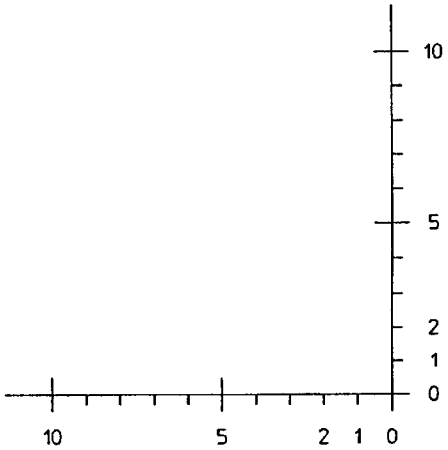

SCREW ROTOR SET

The invention concerns measures for balancing a screw rotor set in an axially parallel arrangement engaging in opposite directions in the external axes and with wrap angles of at least 720° in a single-thread construction.

The centre of gravity centreline distance, end face and wrap angle thereby determine the extent of static and dynamic unbalance which occurs in screws with single-thread profiles.

In publication Sho 62 (1987)-291486 by the firm Taiko of Japan, a method is described for screw balancing: static balancing is firstly achieved by setting the screw length to integral multiples of pitch. Cavities on both sides of the end face of the screw, which are hollow or filled with light material, provide dynamic balancing.

This method of balancing is not feasible where special materials are required which cannot be cast. With unusual profile geometries as well, this method has its limits, as firstly the wall thickness of the screws cannot be reduced freely for reasons of stability, and on the other hand too large an axial elongation of the balancing cavities due to the spiral form entails substantial production problems; filling the cavities with light material exacerbates this problem.

In Swiss patent application 3487/95 by Busch S. A., Switzerland, another method of screw balancing is described: the screw length ($=2W_2$) is greater by integral multiples of pitch 1 than 1½ times the pitch ($2W_2=5\cdot½$, $7\cdot½$, $9\cdot½$, etc.)

To compensate the remaining static and dynamic unbalance, modifications are made to the inlet side on external passive screw components and/or one or more balancing cavities on the end faces and/or external additional masses.

This method offers on the one hand the option of using special materials or enables on the other hand a reduction in balancing cavities, thereby achieving an increase in stability of form.

The use of screw rotors for pumping certain media and the reduction in temperature sought on the screw end on the outlet side require small, smooth, cavity-free screw surfaces, which deflect dirt and are easy to clean. The requirements for a reduction in costs of maintenance, assembly, spare parts stocks and for small, compact pumps run counter to the use of external additional masses.

The invention is based on the task of defining measures to balance single-thread screws with cavity-free smooth surfaces without using external additional masses.

This task is resolved for a screw rotor set for screw pumps in an axially parallel arrangement engaging in opposite directions in the external axes and with wrap angles of at least 720° in a single-thread construction, and with smooth plane-parallel rotor end faces, by each screw rotor consisting of several individual parts fixed rigidly together with a common axis of rotation, optionally eccentric centre of gravity positions and optionally different material densities; the individual parts inside the rotor form a cavity sealed off from the pump chamber, the balancing cavity; adjustment of the material density and the geometry of the individual parts inside the rotor cause static balancing and affect dynamic unbalance, and dynamic balancing is achieved with little effect on static unbalance by calculated determination of the screw length/pitch ratio=a at values which are somewhat smaller than uneven multiples of ½.

Configuration options in the context of the specified screw geometry lie in the choice of number, shape and material of the individual rotor parts and in the configuration of the balancing cavity 3, as described in the characteristic subsidiary claims.

Increased production costs are offset by the following advantages obtained with the invention:

1. Smooth, cavity-free surface facilitating process and maintenance.
2. Reduction in temperature on the screw end by a reduction in surface.
3. Optimisation of material selection for individual parts with different chemical and mechanical stresses.
4. Ease of assembly, spare parts procurement and storage.
5. Small, compact construction that is stable in formn.
6. Modular design with combinations of screw bodies with different rotor shafts.
7. Possibility of interior rotor cooling.

The invention is explained in more detail with the examples of construction shown in the Figures:

The figures show:

FIG. 1: A screw rotor set with pilot gearing for a screw pump in single-thread construction as per the invention composed of individual parts with eccentric interior mass concentration and with a screw length/pitch ratio=2 $W_2/1<9/2$ in an axial section.

Figure 2:
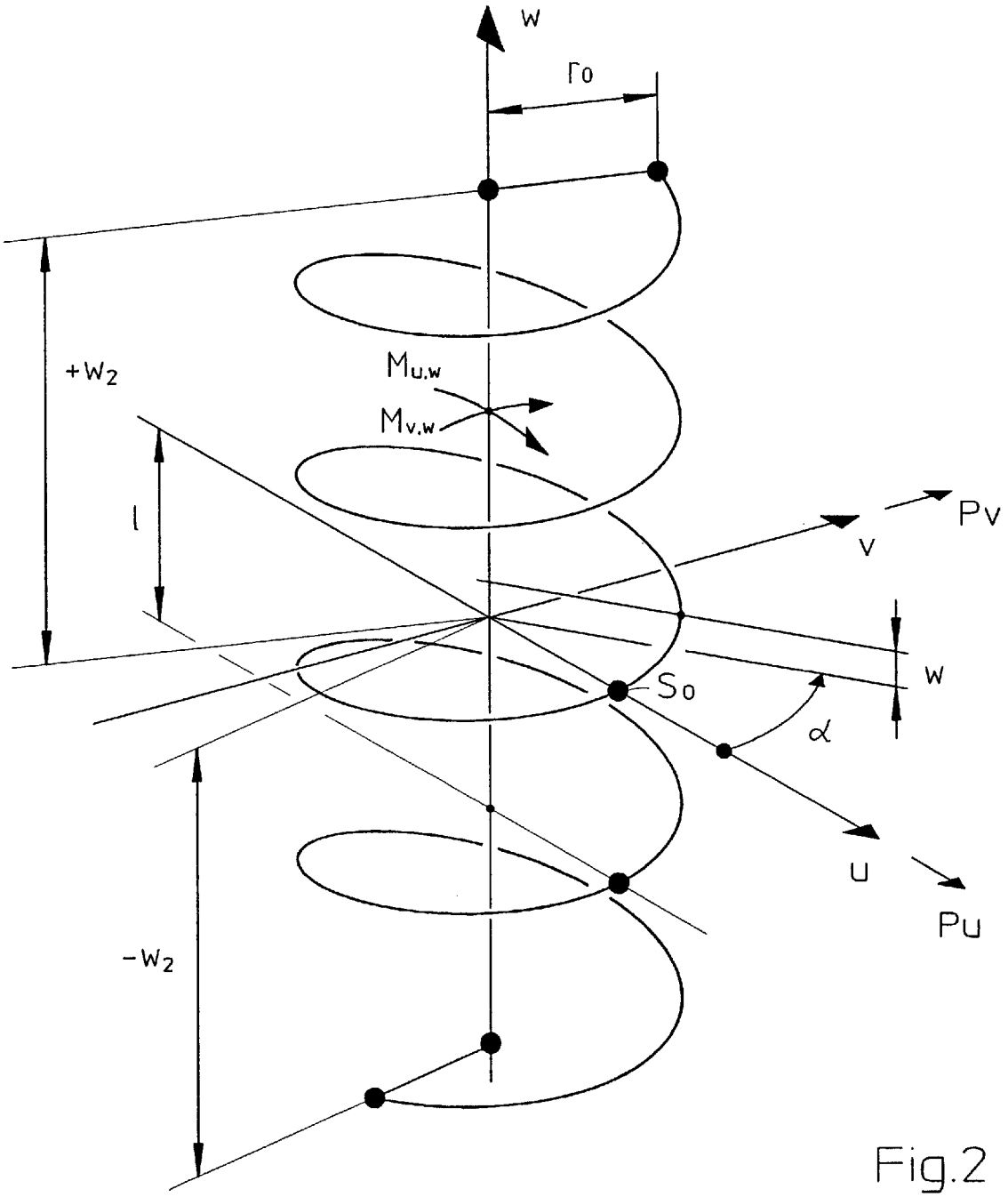

FIG. 2: Representation of the spiral locus curve of the cross-section centre of gravity of a right-hand pitch screw as in FIG. 1.

FIG. 3: An example of construction of a rotor of a screw rotor set as per FIG. 1 in two-part construction in an initial variant with balancing cavity divided by a wing-shape in an axial section.

FIG. 4: A rotor as in FIG. 3 in a cross-section corresponding to line A—A.

Figure 5:
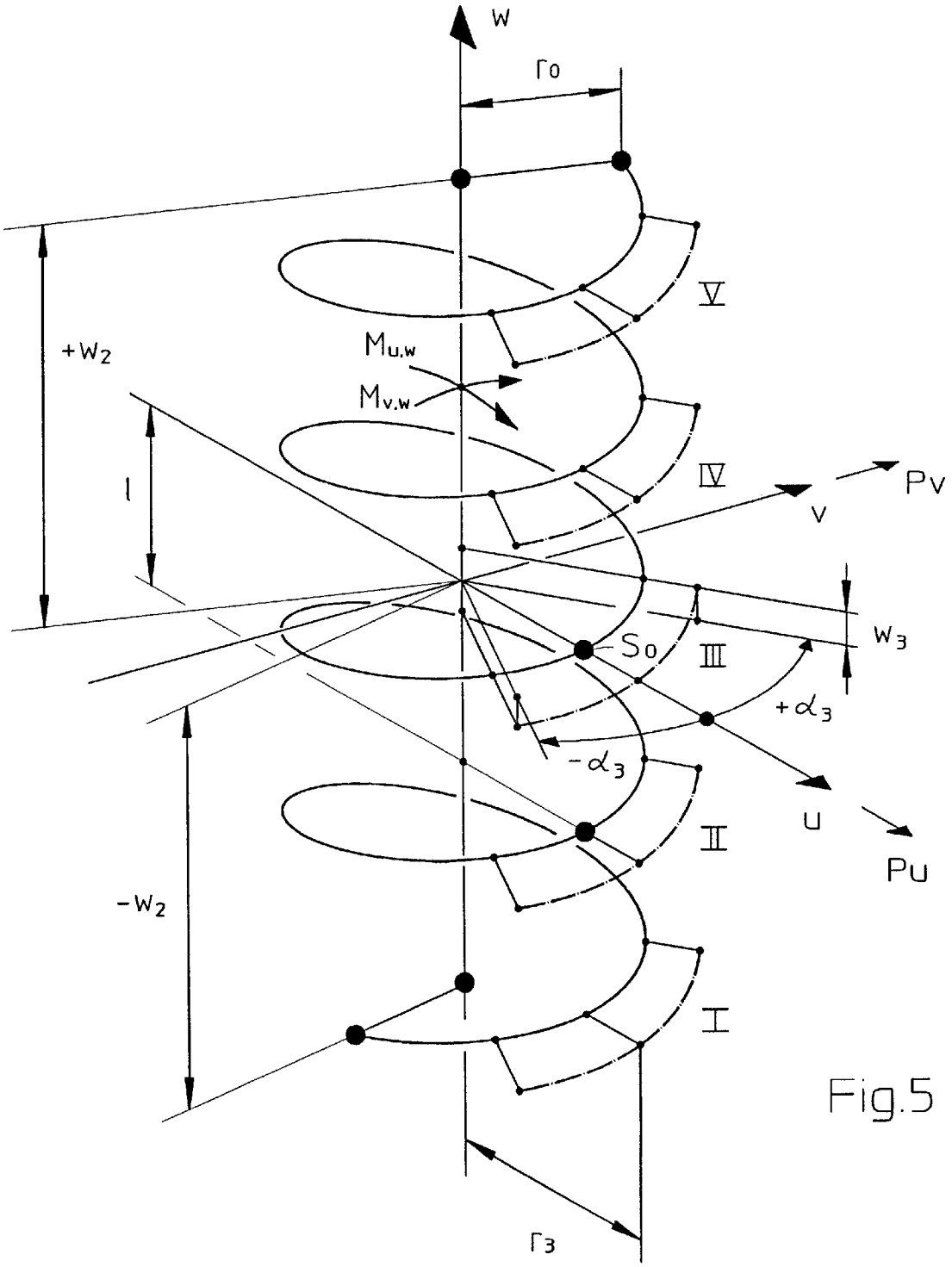

FIG. 5: Representation of the spiral locus curve of the cross-section centre of gravity and as a broken line of the locus curve branches I, II, III, IV, V of the cross-section centre of gravity of the balancing cavity in wing arrangement as in FIGS. 3, 4.

Figure 6:
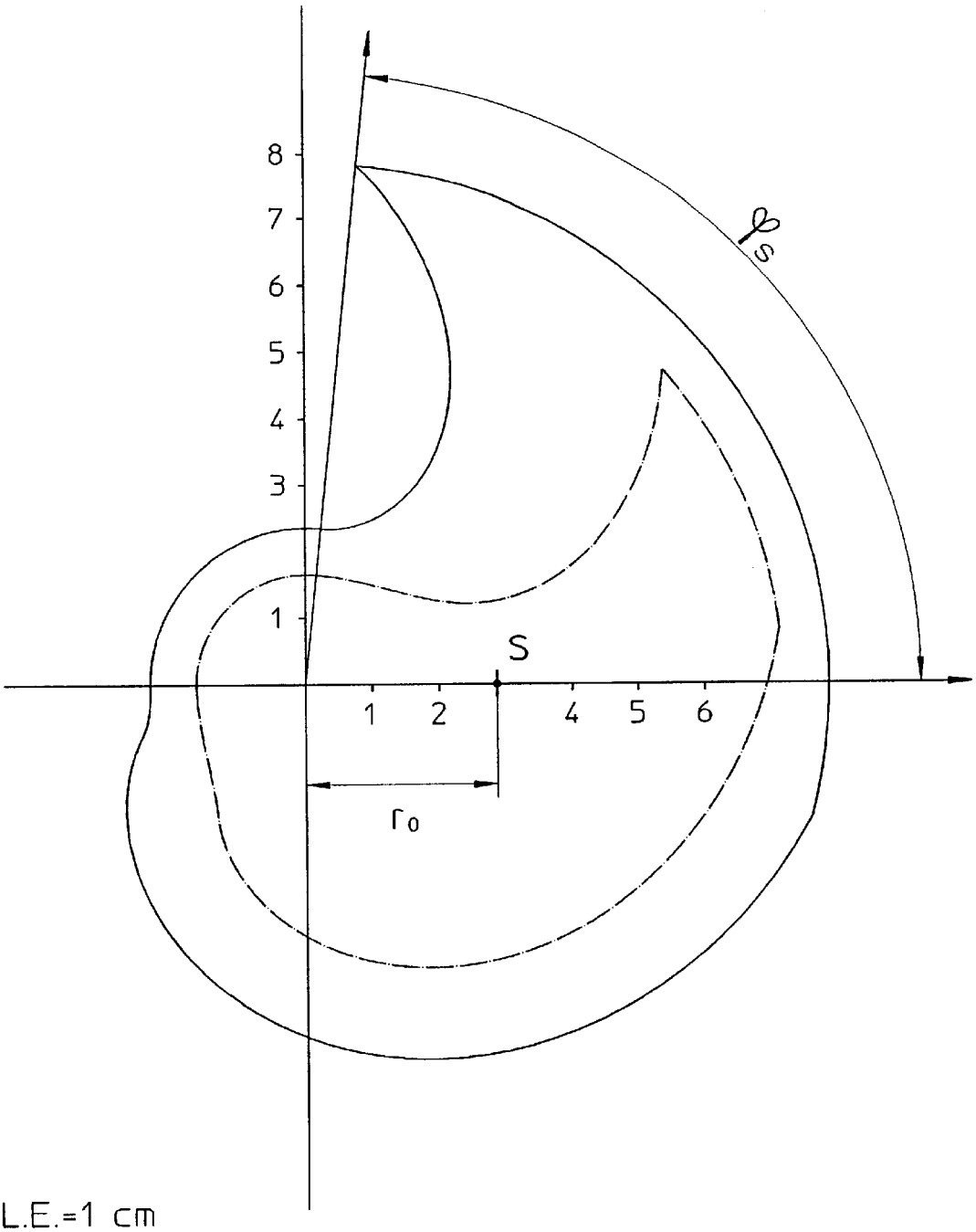

FIG. 6: End face section geometry of the first rotor variant with centre of gravity and maximum admissible inner cavity.

Figure 7:
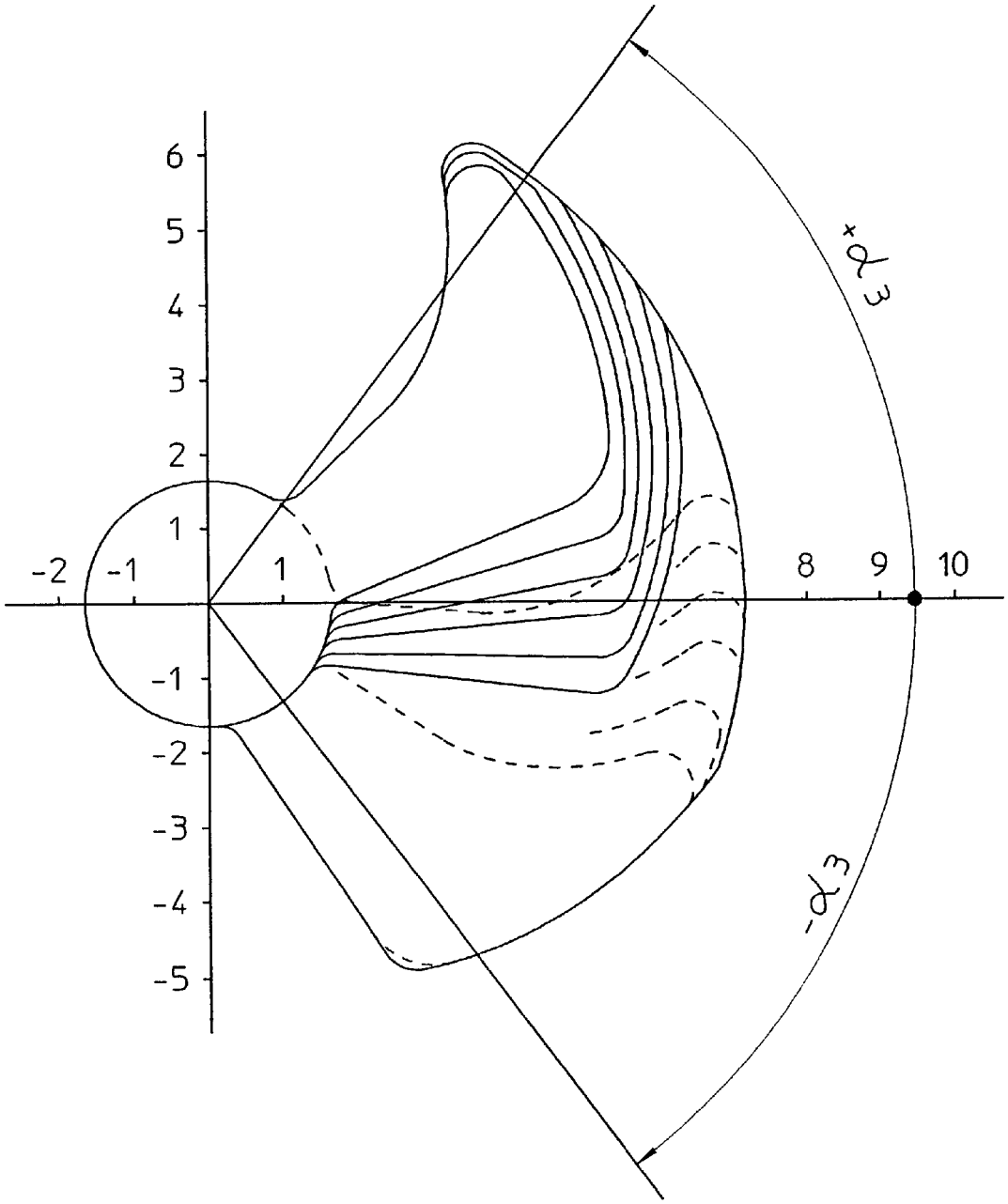

FIG. 7: Different end face section contours of a balancing cavity 103, varying with the axial position W.

FIG. 8: An example of construction of a rotor of the screw rotor set in FIG. 1 in a two-part construction in a second variant with a straight balancing cavity in an axial section.

FIG. 9: The rotor in FIG. 4 in the end face section corresponding to line B—B.

Figure 10:
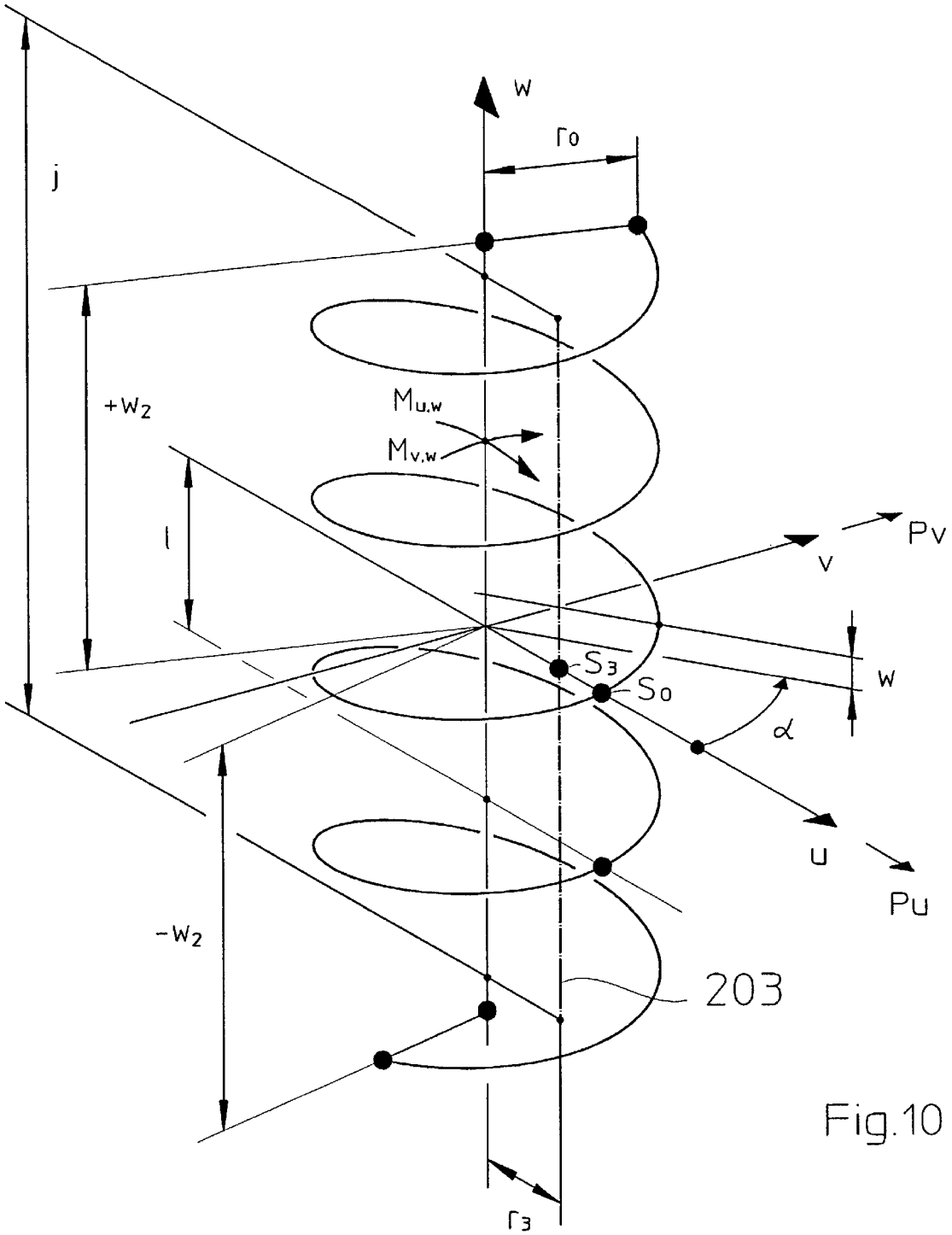

FIG. 10: Representation of the spiral locus curve of the cross-section centre of gravity and as a broken line, the axis through the centre of gravity of the straight balancing cavity in FIGS. 8, 9.

Figure 11:
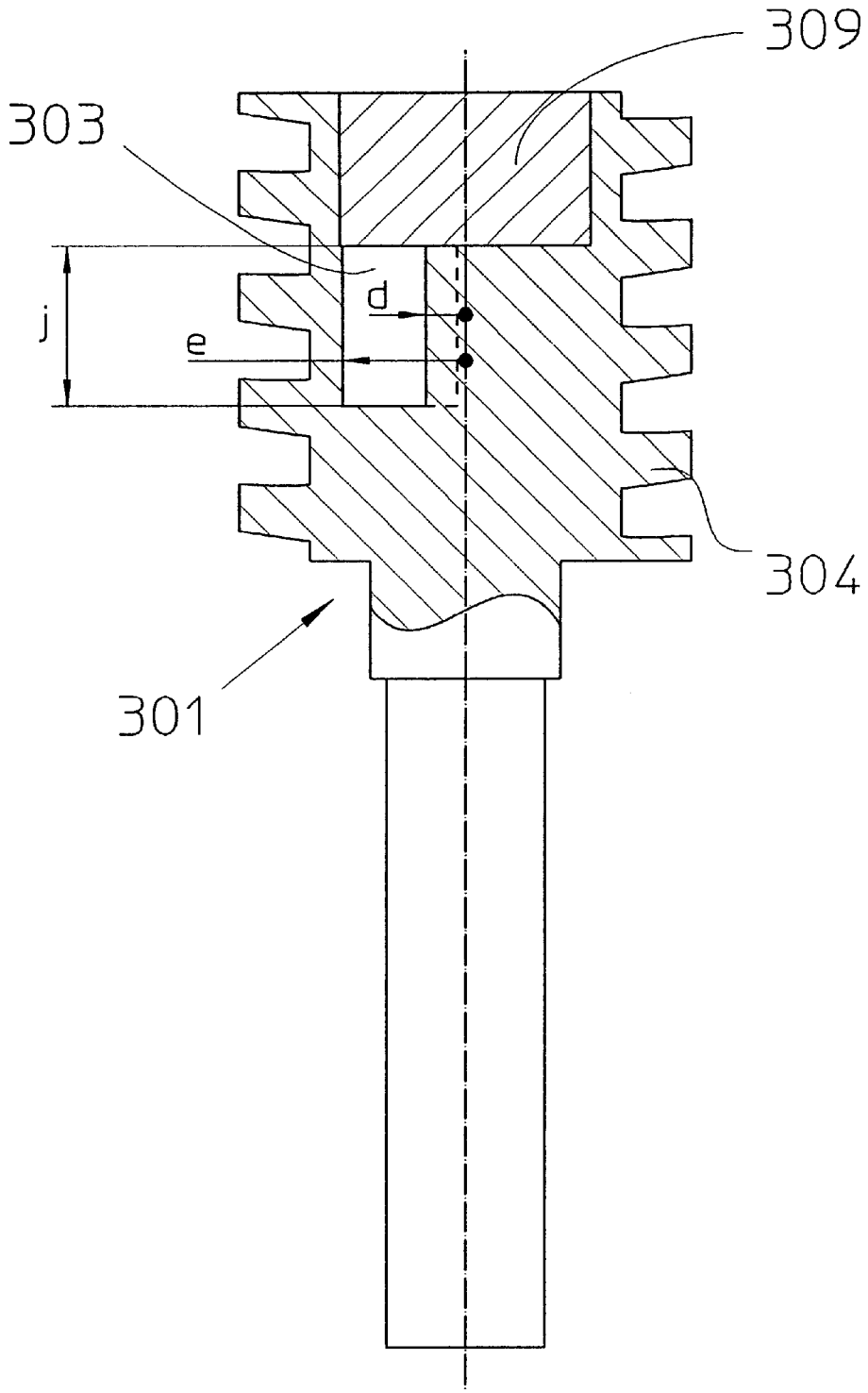

FIG. 11: An example of construction of a rotor as in FIG. 8 in a subsidiary variant with single-sided rotor shaft.

In one example of construction, the screw rotors 101; 201 (FIGS. 3, 4; 8, 9) are formed from two parts, a cylindrical screw body and a coaxial rotor shaft. The screw body 104; 204 (FIGS. 3; 8) has a screw thread of about 9/2 wraps and a coaxial centre bore. Inside the screw body 104; 204 the centre bore 106; 206 (FIGS. 3; 8) is extended into an eccentric cavity, termed the balancing cavity (103; 203 (FIGS. 3; 8). In the centre bore 106; 206 of the screw body 104; 204 the rotor shaft 105; 205 (FIGS. 3; 8) is press-fitted, thus sealing the balancing cavity 103; 203 outwards. A form-fit area ensures transmission of torque between the rotor shaft 105; 205 and the screw body 104; 204. For manufacturing and strength reasons, the screw body 104; 204 and rotor shaft 105; 205 are made from different metals.

A channel 107; 207 (FIGS. 3; 8) provided in the rotor shaft 105; 205 ensures ventilation or cooling of the balancing cavity 103; 203 from a point sealed off from the pumping medium; this construction shows a centre bore leading from the inlet side with a transverse bore in the area of the balancing cavity for ventilation.

Calculation processing:

In a rectangular coordinate system u, v, w, the following relations apply to any shape of body of uniform density on rotation around the w-axis and elongation p≦w≦q:

$$P_u = \omega^2 \cdot \tau \cdot \int_p^q (g\langle\omega\rangle) \cdot \cos(\phi\langle\omega\rangle)\, dw \quad (1)$$

$$P_v = \omega^2 \cdot \tau \cdot \int_p^q (g\langle\omega\rangle) \cdot \sin(\phi\langle\omega\rangle)\, dw \quad (2)$$

$$M_{v,w} = \omega^2 \cdot \tau \cdot \int_p^q (g\langle\omega\rangle) \cdot w \cdot \sin(\phi\langle\omega\rangle)\, dw \quad (3)$$

$$M_{uw} = \omega^2 \cdot \tau \cdot \int_p^q (g\langle\omega\rangle) \cdot w \cdot \cos(\phi\langle\omega\rangle)\, dw \quad (4)$$

where:

| | | |
|---|---|---|
| $p, q$ | = integration limits | [cm] |
| $P_u, P_v$ | = power components | [g] |
| $M_{u,v}, M_{v,w}$ | = torque components | [gcm] |
| $\omega = 2\pi/T$ | = revolution speed | [rad/sec] |
| $\pi$ | = Number of loops = 3.1415… | |
| $T$ | = Duration of a revolution | [sec] |
| $\tau = \gamma/b$ | | [g sec$^2$/cm$^4$] |
| $\gamma$ | = Specific weight | [g/cm$^3$] |
| $b$ | = Ground acceleration = 981 | [cm/sec$^2$] |
| $g\langle w\rangle = f\langle w\rangle \cdot r\langle w\rangle$ | | [cm$^3$] |
| $f\langle w\rangle$ | = End face section surface as a function of $w$ | [cm$^2$] |
| $r\langle w\rangle$ | = Centre of gravity centre distance as a function of $w$ | [cm] |
| $\phi\langle w\rangle$ | = Centre of gravity position angle as a function of $w$ | [rad] |

For a screw body in the u, v, w system (FIG. 2) with centre end face section in the u-v plane and centre of gravity So of the centre end face section on the u-axis and with constant pitch 1, constant front surface fo and constant centre of gravity centre distance $r_0$, the following can be derived in particular $$g\langle w\rangle = g_0 = f_0 - r_0 = \text{constant} \quad (5)$$

$$f\langle w\rangle = \alpha = (2\pi/l) \cdot W \quad (6)$$

Due to the symmetrical elongation of $-W_2 \ldots +W_2$ corresponding to positioning angles of $-\alpha_2 \ldots +\alpha_2$, the following also applies:

$$p = -W_2 \quad (7)$$

$$q = +W_2 \quad (8)$$

$$W_2 = \alpha_2 \cdot (\tfrac{1}{2}\pi) \quad (6a)$$

From this symmetry, the following derives directly for the unbalanced screw (=solid screw):

$$P_V = \emptyset \quad (2a)$$

$$M_{u,w} = \emptyset \quad (4a)$$

The remaining components are determined as follows:

From (1), (5), (6), (6a), (7), (8)→

$$P_u = \omega^2 \cdot \tau_0 \cdot g_0 \cdot \int_{-W2}^{+W2} \cos(2\pi w/l)\, dw = \omega^2 \cdot \tau_0 \cdot (g_0 \cdot (1/\pi) \cdot \sin\alpha_2) \quad (1a)$$

From (3), (5), (6), (6a), (7), (8)→

$$M_{v,w} = \omega^2 \cdot \tau_0 \cdot g_0 \cdot \int_{-W2}^{+W2} w \cdot \sin(2\pi w/l)\, dw = \omega^2 \cdot \tau_0 \cdot (g_0 \cdot (1/\pi)^2 \cdot (\sin\alpha_2 - \alpha_2\cos\alpha_2)/2) \quad (3a)$$

where:

| | | |
|---|---|---|
| $\tau_0 = \gamma_0/b$ | | [g sec$^2$/cm$^4$] |
| $\gamma_0$ | = Specific weight of screw body | [g/cm$^3$] |
| $l$ | = Pitch | [cm] |
| $r_0$ | = Centre of gravity centre distance of solid screw end face | [cm] |
| $f_0$ | = Front surface of solid screw | [cm$^2$] |
| $\tau = 1/2$ | screw wrap angle | [rad] |

1 and $g_0$ are determined by the screw geometry; ω is a parameter dependent purely on operation with ω>Ø; $\tau_0$ is dependent on material and thus conditionally variable with $\tau_0$>Ø; the main variable is the wrap angle=$2\alpha_2$.

By varying only $\alpha_2$, it is not possible to obtain $P_u$=Ø and $M_{v,w}$=Ø at the same time (static and dynamic balancing). In the present patent application, eccentric mass concentrations are formed inside the screw without external additional masses and without end face balancing cavities.

With the example of construction described here, the rotor shaft has no effect on unbalance; the balancing cavity is formed inside the solid screw and this alone supplies the compensation for static and dynamic unbalance this means that the problem is reduced here to pure form configuration without the influence of material data, i.e. the static and dynamic values of the solid screw and balancing cavity have to be compatible such that the following 4 equations are fulfilled:

$$P_v/\omega^2\tau_0 = \emptyset = \int_{p3}^{q3} (g_3\langle\omega\rangle) \cdot \sin(\phi_3\langle\omega\rangle)\, dw \quad (2b)$$

$$M_{u,w}/\omega^2\tau_0 = \emptyset = \int_{p3}^{q3} (g_3\langle\omega\rangle) \cdot w \cdot \cos(\phi_3\langle\omega\rangle)\, dw \quad (4b)$$

$$P_u/\omega^2\tau_0 = g_0 \cdot (1/\pi) \cdot \sin\alpha_2 = \int_{p3}^{q3} (g_3\langle\omega\rangle) \cdot \cos(\phi_3\langle\omega\rangle)\, dw \quad (1b)$$

$$M_{v,w}/\omega^2\tau_0 = \underbrace{g_0 \cdot (1/\pi)^2 \cdot (\sin\alpha_2 - \alpha_2\cos\alpha_2)/2}_{Solid\ screw} = \int_{p3}^{q3} \underbrace{(g_3\langle\omega\rangle) \cdot w \cdot \sin(\phi_3\langle\omega\rangle)\, dw}_{Balancing\ cavity} \quad (3b)$$

Here the index <<$_3$>> indicates association with the balancing cavity.

In the first variant (FIGS. 3, 4) of the example of construction, the required thread depth t (FIG. 3) is relatively large, corresponding to a relatively small core diameter c (FIG. 3). The effective balancing cavity 103 here consists of three wound congruent wings 108 arranged equidistant and aligned axially (FIG. 4), which follow the path of the screw thread at a parallel distance. In FIG. 5 the dotted line shows 5 potential wing positions I–V; in the variant construction here, only the centre positions II, III, IV are used (rough estimation).

With this type of balancing cavity design 103, by varying the wing size and shape, the static value is substantially modified but the dynamic value very little. With the unbalanced screw, by changing the screw length (=2 $W_2$) substantial dynamic changes and slight static changes are, however, obtained in the region of uneven multiples of half pitch.

From the given screw end face section contour (FIG. 6), the surface $f_0$ and centre of gravity position $r_0$, $\phi_s$, can then be determined by the relevant known methods. This gives:

$$f_0=91.189\ [\mathrm{cm}^2];\ r_0=2.869\ [\mathrm{cm}];\ \phi_2=84.178[\measuredangle^0]$$

From this we can determine→$g_0=f_0 \cdot r_0=261.636\ [\mathrm{cm}^3]$

With the pitch 1 (likewise specified)=6.936 [cm], for the solid screw with a variation in $\alpha_2$ from (1b) and (3b) direct values are obtained, as shown in Table 1.

The shape of the balancing cavity cannot necessarily be derived from the conditions (2b), (4b), (1b), (3b); it is instead necessary to determine a geometry first, then determine said four angle data for this, then correct the geometry, re-calculate said four angle data, etc. until such time as (2b), (4b), (1b), (3b) are fulfilled with sufficient accuracy.

The limit on expansion of the balancing cavity is determined by a minimum wall thickness dictated by stability. Due to curvature of the screw surface which varies spatially, the limit line on the end face section can only be determined by calculation: the front sector contour and pitch 1 give a normal vector for each point on the screw surface, of an amount equivalent to the minimum wall thickness. The end point of the vector is then screwed into a fixed plane (w=constant) and gives one point on the limit line. Using a special computer program, with a subroutine containing the specific profile formulae, the curve data of the limit line shown as a broken line in FIG. 6 were calculated for a wall thickness of 0.7 [cm].

Due to the complex spiral form, feasible functions $g_3$<w> and $\phi_3$<w> can be represented mathematically only in a very complicated manner and with additional problems with subsequent integration ((1b) . . . 4b) ); an approximation method with ultimate totalling of numerous small partial amounts by computer program provides a faster solution:

For this, the balancing cavity is divided into N discs offset axially one behind the other, all of the same thickness ΔW. The front contour of each disc is defined separately by numerous individual points and is stored in this form.

A computer subroutine then calculates the values $g_n$ and $\phi_n$ from this for each disc and stores these in the field data memory.

A further computer program calls in these values again and forms the integral values by totalling:

$$P_v/\omega^2\tau_0 = \Delta W \cdot \sum_{n=1}^{N} g_n \cdot \sin\phi_n \quad [\mathrm{cm}^4] \tag{2c}$$

$$M_{u,w}/\omega^2\tau_0 = \Delta W \cdot \sum_{n=1}^{N} g_n \cdot W_n \cdot \cos\phi_n \quad [\mathrm{cm}^5] \tag{4c}$$

-continued $$P_u/\omega^2\tau_0 = \Delta W \cdot \sum_{n=1}^{N} g_n \cdot \cos\phi_n \quad [\mathrm{cm}^4] \tag{1c}$$

$$M_{v,w}/\omega^2\tau_0 = \Delta W \cdot \sum_{n=1}^{N} g_n \cdot W_n \cdot \sin\phi_n \quad [\mathrm{cm}^5] \tag{3c}$$

In construction, the disc end face section contour is now optimally extended to the limit line (shown as a broken line in FIG. 6) in the centre area of the wing and the centre of gravity positions of the solid screw and balancing cavity superimposed 108 (FIG. 4).

The centre section extends over a (now) variable number of identical discs m, the end areas each have 5 discs of decreasing contour (FIG. 7). With ΔW=0.108 [cm] and by varying m, the values shown in Table 2 are obtained for the 3-winged balancing cavity.

A good approximation is obtained with values $\alpha_2$=806.8 . . . 806.9 [$\measuredangle^0$] and m=10. Fine adjustment is then obtained by correcting the disc geometry. Values for the ratio of screw length/pitch determined by calculation in this case are 2 $W_2$/1=a=4.4825<9/2.

In a second variant (FIGS. 8, 9) of the example of construction, the required thread depth t (FIG. 8) is relatively small, corresponding to a relatively large core diameter c (FIG. 8). The effective balancing cavity 203 (FIG. 8) runs in a straight line, axially parallel with constant cross-section (FIG. 9) eccentrically within the screw core area, centered axially (FIG. 10).

This form of balancing cavity 203 has not effect on dynamic unbalance. With calculation processing, the exact value $a_o$=screw length/pitch in the region of 9/2 wraps is then determined by means of (3a), for which the dynamic unbalance of the screw is likewise equal to <<zero>>. This value $a_o$ is not dependent on profile. Some values for different wraps are given in table 3. From this, the (profile-dependent) value of static unbalance of the screw is obtained directly with (1a):

$$P_u/\omega^2\tau_0 = g_0 \cdot (1/\pi)\sin\alpha_2$$

$$\alpha_2 = 14.0662 \quad [\mathrm{rad}]$$

$$1 = 5.390 \quad [\mathrm{cm}]$$

$$g_0 = 150.374 \quad [\mathrm{cm}^3]$$

$$P_u/\omega^2\tau_0 = 257.347 \quad [\mathrm{cm}^4]$$

This value equates with the value of the balancing cavity 203 by adjusting the cross-section and length:

c=2.85 [cm]

d=1.6 [cm]→j=20.3 [cm]

With a subsidiary variant (FIG. 11) of the second variant, the screw rotor 302 is bearing-mounted so that it projects on the rotor shaft fixed coaxially on one side to the screw body. The eccentric balancing cavity 303 is accessible from the axis-free end face of the screw rotor via a large coaxial bore and can thus be made in several ways. The screw body and rotor shaft preferably form a monobloc unit, and the coaxial bore on the rotor end face is optionally sealed with a plug 309. Particular proportions of the screw body, dictated inter alia by the single-side bearing, give different proportions e, d, j of the balancing cavity 303 with the same calculation procedure.

Screw rotors with profile geometries of both variants of the example of construction described as per the proportions given in FIGS. 3, 4, 6, 7; 8, 9 were calculated theoretically and by computer, constructed for 1 length unit (L.E.)=1 cm and successfully tested.

TABLE 1

| $\alpha_2$ [<°] | $P_u/\omega^2\tau_0$ [cm$^4$] | $M_{v,w}/\omega^2\tau_0$ [cm$^5$] |
|---|---|---|
| 807.4 | 577.045 | 229.381 |
| 807.3 | 576.998 | 213.715 |
| 807.2 | 576.950 | 198.053 |
| 807.1 | 576.900 | 182.394 |
| 807.0 | 576.848 | 166.739 |
| 806.9 | 576.794 | 151.087 |
| 806.8 | 576.739 | 135.438 |
| 806.7 | 576.682 | 119.793 |
| 806.6 | 576.623 | 104.151 |

TABLE 2

| m | $P_u/\omega^2\tau_0$ [cm$^4$] | $M_{v,w}/\omega^2\tau_0$ [cm$^5$] | $P_v/\omega^2\tau_0$ [cm$^4$] | $M_{u,w}/\omega^2\tau_0$ [cm$^5$] |
|---|---|---|---|---|
| 13 | 641.926 | 231.623 | −3.902 | 3.970 |
| 12 | 619.980 | 199.530 | −4.081 | 3.574 |
| 11 | 596.549 | 170.234 | −4.251 | 3.192 |
| 10 | 571.692 | 143.681 | −4.410 | 2.824 |
| 9 | 545.467 | 119.803 | −4.559 | 2.473 |
| 8 | 517.937 | 98.519 | −4.697 | 2.140 |
| 7 | 489.169 | 79.735 | −4.824 | 1.827 |

TABLE 3

| Ratio of screw length / pitch = $a_o = 2W_2/l$ for a straight balancing cavity of constant cross-section | | | | | | |
|---|---|---|---|---|---|---|
| $a_o = 2W_2/l = 2\ \alpha_2/2\pi$ | 2.459 | 3.471 | 4.477 | 5.481 | 6.484 | 7.486 |
| Uneven multiples of ½ | 5/2 | 7/2 | 9/2 | 11/2 | 13/2 | 15/2 etc. |

What is claimed is:

1. A screw rotor set for screw pumps in an axially parallel arrangement engaging in opposite directions in the external axes and with wrap angles of at least 720° in a single-thread construction, and with smooth plane-parallel rotor end faces, wherein each screw rotor consists of several individual parts fixed rigidly together with a common axis of rotation, with eccentric centre of gravity positions and with different material densities; the individual parts inside the rotor form an eccentric balancing cavity separable from the pump chamber; adjustment of the material density and the geometry of the individual parts inside the rotor cause static balancing and affect dynamic unbalance, and dynamic balancing is achieved with little effect on static unbalance by calculated determination of the screw length/pitch ratio=a at values which are close to but smaller than the next higher uneven multiple of ½.

2. A screw rotor set as per claim 1, wherein each screw rotor consists of a cylindrical screw body and a coaxial rotor shaft, which form the balancing cavity inside the screw body.

3. A screw rotor set as per claim 1, wherein each screw rotor consists of a cylindrical screw body and a coaxial rotor shaft with a cross-section bearing-mounted eccentrically inside the screw body and the screw body and rotor shaft are made of materials of difference density.

4. A screw rotor set as per claim 1, wherein each screw rotor consists of a cylindrical screw body and a coaxial rotor shaft with a cross-section bearing-mounted eccentrically inside the screw body and the screw body and rotor shaft are made of materials of different density and form an eccentric hollow cavity, the balancing cavity inside the screw body.

5. A screw rotor set as per claim 1, wherein each screw rotor consists of a cylindrical screw body with a rotor shaft applied coaxially on one side and the screw body has an eccentric hollow cavity, the balancing cavity on the inside, whose access on the shaft-free end face of the rotor can be sealed optionally with a plug.

6. A screw rotor set as per claim 2, wherein the balancing cavity has several wing-type extensions on the side, which follow the screw thread with parallel centreline.

7. A screw rotor set as per claim 4, wherein the balancing cavity has several wing-type extensions on the side, which follow the screw thread with parallel centreline.

8. A screw rotor set as per claim 2, wherein the balancing cavity runs axially in a straight line with constant cross-section, so that the effect on the dynamic unbalance is equal to <<zero>>.

9. A screw rotor set as per claim 4, wherein the balancing cavity runs axially in a straight line with constant cross-section, so that the effect on the dynamic unbalance is equal to <<zero>>.

10. A screw rotor set as per claim 5, wherein the balancing cavity runs axially in a straight line with constant cross-section, so that the effect on the dynamic unbalance is equal to <<zero>>.

11. A screw rotor set as per claim 2, wherein the balancing cavity is ventilated or cooled by means of a channel arranged over the rotor shaft.

12. A screw pump with a rotor set as per claim 1.
13. A screw pump with a rotor set as per claim 2.
14. A screw pump with a rotor set as per claim 3.
15. A screw pump with a rotor set as per claim 4.
16. A screw pump with a rotor set as per claim 5.
17. A screw pump with a rotor set as per claim 6.
18. A screw pump with a rotor set as per claim 7.
19. A screw pump with a rotor set as per claim 8.
20. A screw pump with a rotor set as per claim 11.

* * * * *

UNITED STATES PATENT AND TRADEMARK OFFICE

CERTIFICATE OF CORRECTION

PATENT NO. : 6,158,996
DATED : December 12, 2000
INVENTOR(S) : Ulrich Becher

It is certified that error appears in the above-identified patent and that said Letters Patent is hereby corrected as shown below:

Title page,
Under Foreign Application Priority Data, please delete "22331/96" and insert in lieu thereof -- 2233/96 --.

Column 2,
Line 12, please change "formn" to -- form --.

Column 3,
Line 8, please change "$p \leqq w \leqq q$:" to -- $p \leq w \leq q$: --.
Line 25, please change "$M_{u,v,}$" to -- $M_{u,w,}$ --.

Column 4,
Line 25, please change "$\tau$" to -- $\alpha_2$ --.

Column 5,
Line 16, please change "$\phi_s$" to -- $\varphi_s$ --.
Line 18, please change "$\phi_2$" to -- $\varphi_2$ --.

Column 6,
Line 53, please change "c=2.85 [cm]" to -- e=2.85 [cm] --.

Signed and Sealed this

Twenty-second Day of January, 2002

*Attest:*

*Attesting Officer*

JAMES E. ROGAN
*Director of the United States Patent and Trademark Office*